United States Patent [19]

Allain et al.

[11] Patent Number: 4,686,902

[45] Date of Patent: Aug. 18, 1987

[54] AUTOMATIC BLANKET WASH SYSTEM

[75] Inventors: Raymond J. Allain, Westerly, R.I.; Henry P. Bolduc, Jr., Pawcatuck, Conn.; Thomas R. Patterson, Wyoming; Timothy J. Ingram, Westerly, both of R.I.

[73] Assignee: Precision Engineered Systems Inc., Pawcatuck, Conn.

[21] Appl. No.: 926,379

[22] Filed: Oct. 31, 1986

[51] Int. Cl.[4] ..... B41F 35/06; B41L 41/06

[52] U.S. Cl. ..... 101/424; 101/425; 134/18; 137/240; 137/563; 137/571; 239/61; 239/127

[58] Field of Search ..... 101/423–425; 134/15, 18, 38–40; 137/240, 563, 571, 624.11; 239/61, 127, 142

[56] References Cited

U.S. PATENT DOCUMENTS

| | | | |
|---|---|---|---|
| 2,972,546 | 2/1961 | Adler | 137/563 |
| 3,403,695 | 10/1968 | Hopkins | 137/563 |
| 3,458,133 | 7/1969 | Wiggins | 239/127 |
| 3,524,587 | 8/1970 | Pescatore | 239/127 |
| 3,638,860 | 2/1972 | Carlyon | 239/127 |
| 3,780,942 | 12/1973 | Scharfenberger | 239/127 |
| 3,816,025 | 6/1974 | O'Neill | 239/127 |
| 4,197,995 | 4/1980 | Campbell | 239/127 |
| 4,270,450 | 6/1981 | Difflipp | 101/425 |
| 4,530,465 | 7/1985 | Gauchet | 239/127 |

FOREIGN PATENT DOCUMENTS

| | | | |
|---|---|---|---|
| 748233 | 10/1944 | Fed. Rep. of Germany | 101/425 |

OTHER PUBLICATIONS

WPE Model 404; Automatic Blanket Washer: Web Press Engineering, Inc.; 8–67.

*Primary Examiner*—Clyde I. Coughenour
*Attorney, Agent, or Firm*—Bromberg, Sunstein & Casselman

[57] ABSTRACT

The present invention provides an automatic blanket wash system that recirculates a separable mix of water and solvent. The mix is selectively applied to the blanket cylinders by closing a pressure valve in the recirculation system return line and selectively opening valves to spray bars at the blankets. The pressure valve closing causes a pressure build up in the system for the spraying of the mix onto the blankets.

1 Claim, 3 Drawing Figures

AUTOMATIC BLANKET WASH SYSTEM

DESCRIPTION

1. Technical Field

The present invention relates to printing presses, and more particularly to systems for automatically washing blanket rollers of offset printing units.

2. Background Art

Automatic blanket cleaning systems are known in the art, and one such system, for example, is disclosed in the U.S. Pat. No. 4,344,361, issued for an invention of MacPhee et al. This patent discloses a cleaning system requiring a cloth supply roll to bring a cleaner fabric in contact with the blanket roller; solvent is sprayed onto the fabric. Typically, such an arrangement requires pulling the blankets apart during the cleaning cycle. Another system is disclosed in U.S. Pat. No. 3,486,448, issued for an invention of Anderson et al. The Anderson patent discloses a cleaning system that does not require the use of a cloth, but does not provide an arrangement for dealing with cleaning mixtures that may be subject to settling after the mixing has been accomplished. U.S. Pat. No. 3,508,711, issued for an invention of Switall, discloses another blanket wash system that does not address the settling problem associated with certain cleaning mixtures.

Other cleaning systems for printers are disclosed in U.S. Pat. Nos. 3,896,730 and 4,534,291, issued for inventions of Garrett et al. and Sabota et al. respectively.

Recirculation systems for maintaining mixtures of fountain solutions are disclosed in U.S. Pat. Nos. 4,151,854, issued for an invention of Patsko, and 3,485,257, issued for an invention of Gegenheimer et al.

There remains a need for a blanket wash system that avoids the cumbersome aspects of the cloth approach while providing a spray system that maintains mixing of wash components that may be subject to settling while still providing high pressures that are necessary for spraying.

DISCLOSURE OF INVENTION

The present invention provides an automatic blanket wash system that overcomes these difficulties in the prior art by providing a unit control for each printing unit that is in the fluid path of the upper and lower spray bars associated with each unit; the unit control has a fluid input and a unit valve that is normally closed for permitting the wash mixture to flow, upon electrical actuation, from the fluid input through the spray bars. A supply line from the wash mixture reservoir is in fluid communication with the fluid input of each of the unit controls, and a return line provides fluid communication between the fluid input of the last unit control and the reservoir. The invention provides a pumping arrangement to cause circulation of the wash mixture from the reservoir, through the supply line, past the fluid input of each of the unit controls, through the return line, and then back to the reservoir, so that the circulation of the mixture tends to prevent settling of the solvent and to insure homogeneity of the mixture at the fluid input of each of unit control. A wash valve is disposed in the return line and normally open, and on electrical actuation, substantially restricts the flow through the return line, so as to increase fluid pressure in the supply line. On initiation of the wash control cycle, the wash valve is actuated, and thereafter the unit valves are actuated to cause the mixture to be sprayed by the spray bars at higher pressure, while at all other times, circulation of the mixture may be maintained.

BRIEF DESCRIPTION OF THE DRAWINGS

These and other features of the invention will be more readily apparent in the following discussion, taken with the accompanying drawings, in which.

DETAILED DESCRIPTION OF SPECIFIC EMBODIMENTS

Figure 1:
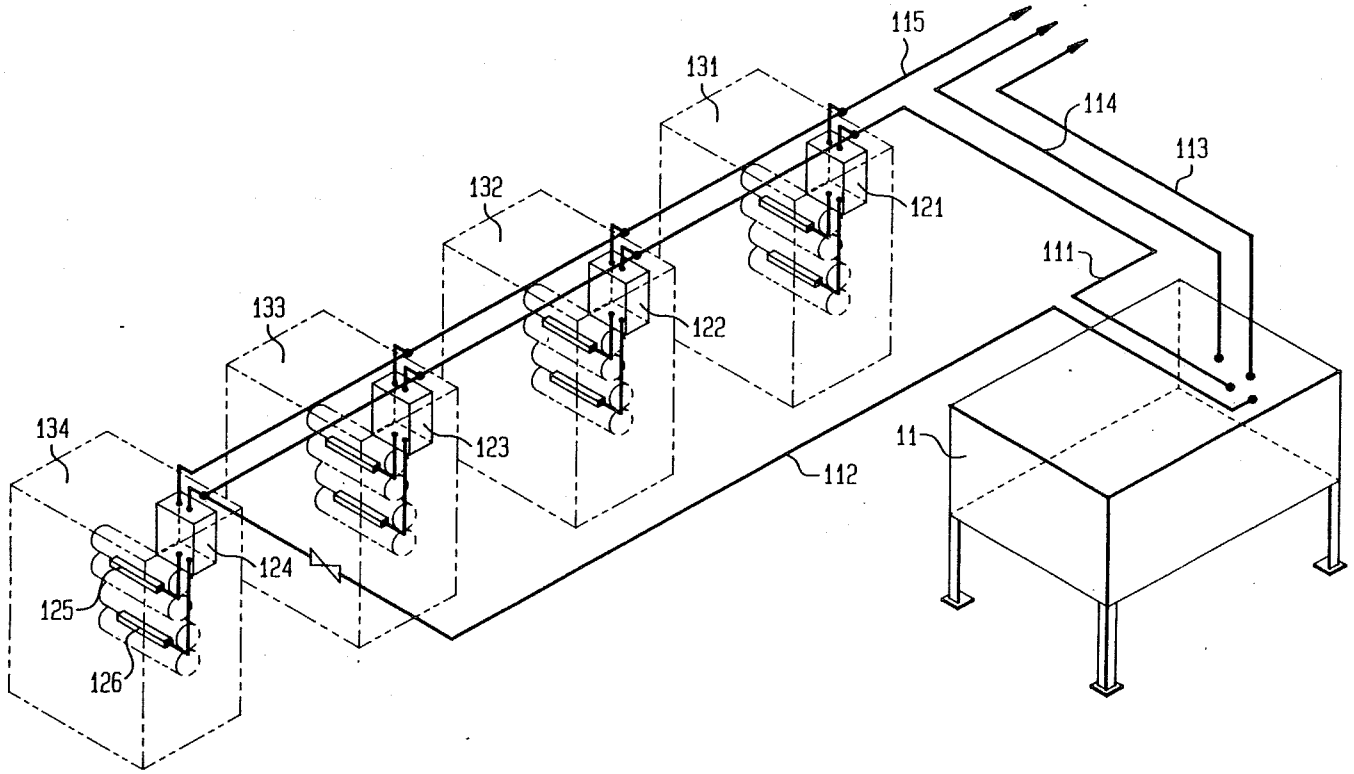
FIG. 1 is a schematic showing the basic fluid flow in accordance with a preferred embodiment of the invention.

Referring now to FIG. 1, there are illustrated a system control enclosure and solution reservoir 11 which receive water over line 114 and washing solvent over line 113. These are permitted to enter a common reservoir in item 11 where they mix. The washing mixture is delivered over supply line 111 to a plurality of unit controls 121, 122, 123, and 124; each unit control is associated with a single printing unit having upper and lower blanket rollers that may be in need of cleaning. These printing units are identified as items 131–134 respectively. By way of example, there is shown upper spray bar 125 and lower spray bar 126 associated with the upper and lower blanket rollers of unit 134. As indicated, similar spray bars are disposed with respect to each of the other printing units. Each spray bar is in fluid communication with the unit control for its particular printing unit. From the most remote unit control, here, item 124, there is provided a return line 112 back to the reservoir in item 11.

Except when the wash cycle has been commenced, the washing mixture is therefore circulated continuously through the supply line 111 and back through the return line 112 to the reservoir. In this fashion the washing mixture is mixed on a continuous basis. The system handles effectively a mixture with water of TEX 300 concentrate, available from Printex Products Corporation, P.O. Box 1479, Rochester, N.Y. 14603. This washing solvent forms a milky-white emulsion when mixed with water, but is subject to settling, unless the mixture is agitated. The present invention provides the agitation by the continuous circulation discussed above.

In operation, at the commencement of a wash cycle, a valve in the path of the return line 112 is closed, causing an increase in pressure in the supply line 111. Thereafter the unit controls 121–124 are actuated to open valves permitting fluid flow from the unit control inputs to the spray bars associated with each unit control. Following the spray of the mixture, air drying is directed in accordance with means known in the art via air supply line 115 to purge the applicable spray bar of any remaining fluid.

Figure 2:
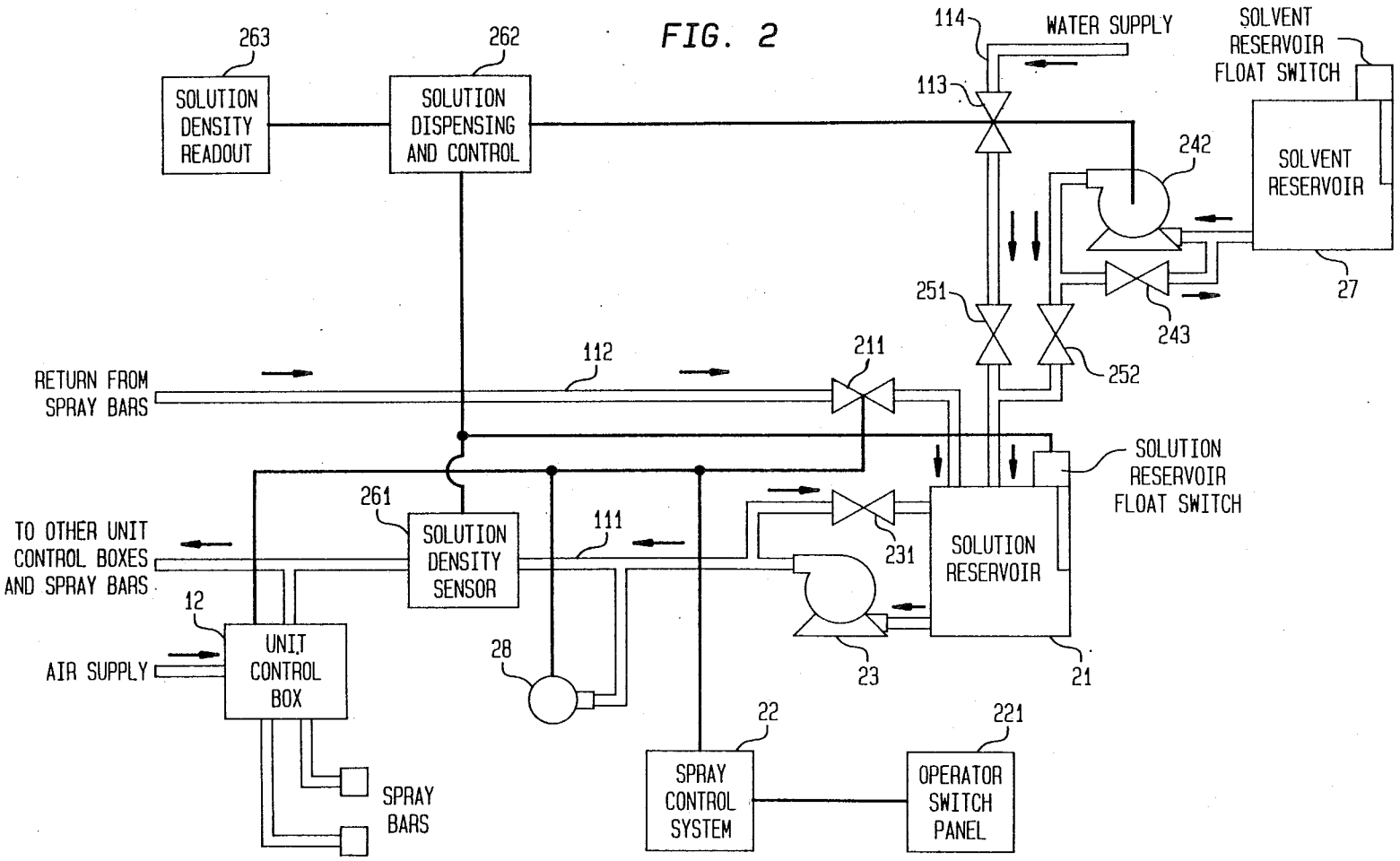
FIG. 2 is a more detailed schematic of the preferred embodiment of the invention showing the manner in which fluid control of the wash system is maintained; and, FIG. 3 illustrates the control panel of a preferred embodiment of the invention.

Turning now to FIG. 2, one may observe solvent reservoir 27 from which solvent is pumped by pump 242 through solvent metering valve 252 into the solution reservoir 21, holding the wash mixture. Water enters under line 114 through water supply valve 113 and water metering valve 251. Pressure in the solvent line is regulated by pressure valve 243. As a result, when solvent and water enter through their respective metering valves, they enter in proportions that may be determined in advance. The specific gravity of the wash mixture is monitored by density sensor 261 and a specific gravity readout 263 is provided, so that if the specific gravity is outside limits, the system may be shut down or the quantities of water or solvent in the reservoir 21 may be altered. In the case of TEX 300-concentrate, a specific gravity of 0.890 plus or minus 0.005 is typical for a proper concentration of the solvent in water of about 60 volume percent of solvent. Further control arrangements relating to specific gravity of wash solutions are disclosed in U.S. Pat. No. 3,848,618, issued for an inventon of Royse, as well as the Patsko and Gegenheimer patents described above.

In normal operation, pump system 23 pumps the wash mixture from reservoir 21 over line 111, past the solution density sensor 261, past each of the unit control boxes, including unit control box 121, which is illustrated with its associated spray bars. After the line 111 passes each of the unit control boxes, there is provided the return 112 back to the solution reservoir 21.

On initiation of the wash cycle, the wash cycle valve 211 is closed by the spray control system 22, and pressure built up in the supply line 111. Assuming that sufficient pressure has been reached, as monitored by system pressure switch 28, the unit control boxes may be actuated by the spray control system 22 to cause the spray bars to receive fluid over the supply line 121. An additional solenoid-actuated air valve is used to direct air into each spray bar, after the bar has sprayed the mixture, so as to purge any remaining fluid from the spray bar.

Maximum pressure in the fluid supply line is regulated by pressure valve 231 interposed between the supply line 111 and the reservoir 21. Typically, the pressure build up is regulated in the vicinity of 80 pounds per square inch (550 K Pa). The actuation of the solenoid valves in the unit control box, and the wash cycle valve, is performed by the spray control system 22 in accordance with systems well known in the art.

Typically, each control unit valve is activated to permit spray of the wash solution to emanate from a spray bar for only about ½ second. The web itself serves to blot the blanket roller. The valves in the unit controls may be activated in any desired sequence. Under one protocol, the printer unit most remote from the web dryer is activated first, then the next most remote, etc.; this protocol minimizes the amount of web wasted, since the portion of the web serving to blot the most remote unit may also serve to blot the next most remote unit, etc. However, in order to minimize the concentration of solvent on the web (to further reduce the risk of explosion in the web drier), another protocol would initiate wash of the printer unit closest to the web drier first, then wash of the printer unit next closest to the web drier, etc. Under this protocol, it is possible to ensure that the portion of the web that has blotted the printer unit closest to the web drier has fully emerged from the web drier before the portion of the web blotting the printer unit next closest to the web drier has entered the drier.

Figure 3:
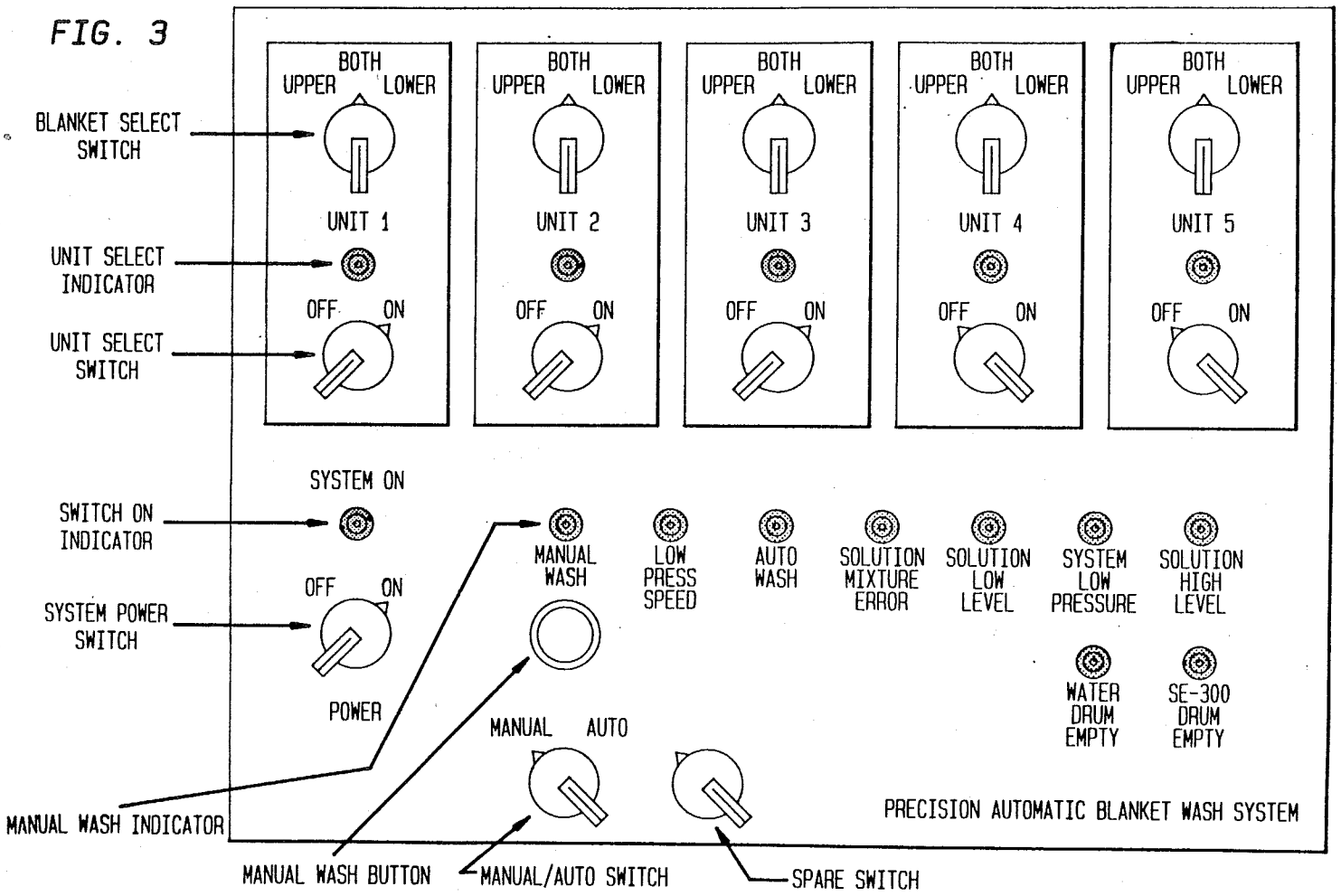

FIG. 3 shows the operator control panel 221, with respect to which the following table is descriptive.

TABLE

| | |
|---|---|
| SYSTEM POWER switch | The SYSTEM POWER switch controls power to the spray system control box. It has no effect on the circulation system. |
| SYSTEM ON Indicator | The SYSTEM ON indicator lights up when the system power switch is turned to the ON position. |
| UNIT SELECT Switch | The UNIT SELECT switch allows the spray sequence to include the corresponding unit. |
| UNIT SELECT Indicator | The UNIT SELECT indicator lights when a unit is selected for spraying. |
| BLANKET SELECT Switch | The BLANKET SELECT switch allows the operator to choose upper, both, or the lower fountain for spraying. The unit must be selected to enable the spray. |
| MANUAL/AUTO Switch | The MANUAL/AUTO switch selects between a manually initiated wash cycle and an automatically initiated wash cycle. |
| MANUAL WASH Button | The MANUAL WASH button is used to manually initiate a wash cycle when the system is set to the MANUAL mode. |
| MANUAL WASH Indicator | The MANUAL WASH indicator lights when a manual wash cycle is in progress. |
| AUTO WASH Indicator | The AUTO WASH indicator lights when an automatically initiated wash cycle is in progress. |
| LOW PRESS SPEED Indicator | The LOW PRESS SPEED indicator lights when the press is not running fast enough (800 FPM) to initiate a wash cycle. A wash cycle cannot be started while this indicator is lighted. |
| SOLUTION MIXTURE ERROR Indicator | The SOLUTION MIXTURE ERROR indicator lights when the solution in the circulation system is improperly mixed. A wash cycle cannot be started when this indicator is lighted. |
| SOLUTION LOW LEVEL Indicator | The SOLUTION LOW LEVEL indicator lights when the amount of solution in the circulation system and wash solution reservoir is inadequate to allow a wash cycle to be initiated. A wash cycle cannot be started when this indicator is lighted. |
| SYSTEM LOW PRESSURE Indicator | The SYSTEM LOW PRESSURE indicator lights when the circulating system cannot build up enough pressure to perform a proper wash cycle. A wash cycle cannot be started when this indicator is lighted. |
| SOLUTION HIGH LEVEL Indicator | The SOLUTION HIGH LEVEL indicator lights when too much solution is in the circulation system and wash solution reservoir. |
| SOLVENT DRUM EMPTY Indicator | The SOLVENT DRUM EMPTY indicator lights when the solvent drum is empty. |

Further information concerning this embodiment is provided in the General System Description, and Technical and Operational Manual, each entitled "Precision Automatic Blanket Wash System," published by Precision Engineered Systems, Inc., P.O. Box 269, Westerly, R.I. 02891, of which copies are incorporated by reference.

What is claimed is:

1. An automatic blanket wash system, for spraying a mixture of a solvent and water onto blanket rollers of printing press units, the system comprising:

(a) a reservoir;

(b) delivery means for delivering quantities of water and solvent into the reservoir in predetermined proportions;

(c) a plurality of spray system units in a fluid path, each spray system unit including (i) upper and lower spray bars for spraying the mixture respectively onto upper and lower blanket rollers of a printing unit with which the spray system unit is associated and (ii) a unit control in the fluid path to each of the upper and lower spray bars, such unit control having a fluid input and unit valve means normally closed, for permitting the mixture to flow, upon electrical actuation, from the fluid input to and through the spray bars;

(d) a supply line in fluid communication with the reservoir and the fluid input of each of the unit controls, one of such fluid inputs being the last of the unit controls along such supply line;

(e) a return line in fluid communication between the fluid input of the last unit control and the reservoir;

(f) pumping means for causing circulation of the mixture from the reservoir through the supply line, past the fluid input of each of the unit controls, through the return line, and then back to the reservoir, so that the circulation of the mixture tends to prevent settling of the solvent and to ensure homogeneity of the mixture at the fluid input of each unit control;

(g) wash valve means, disposed in the return line and normally open, for, on electrical actuation, substantially restricting flow through the return line so as to increase fluid pressure in the supply line; and (h) wash control means, for actuating the wash valve means so as to increase pressure in the supply line, and thereafter to actuate the unit valve means of the unit controls as to cause the mixture to be sprayed by the spray bars.

* * * * *